US006682011B2

(12) United States Patent
Badiali et al.

(10) Patent No.: US 6,682,011 B2
(45) Date of Patent: Jan. 27, 2004

(54) DEVICE FOR COLLECTING YARNS ON CONICAL REELS WITH COMPENSATION OF THE FLUCTUATIONS OF THE YARN TAKE-UP SPEED

(75) Inventors: Roberto Badiali, Pordenone (IT); Vittorio Colussi, Cappella Maggiore (IT); Franco Siega Vignut, Maniago (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 0 days.

(21) Appl. No.: 10/081,567

(22) Filed: Feb. 21, 2002

(65) Prior Publication Data

US 2002/0125357 A1 Sep. 12, 2002

(30) Foreign Application Priority Data

Mar. 1, 2001 (IT) ..... MI2001A0425

(51) Int. Cl.[7] ..... B65H 54/28; B65H 59/72
(52) U.S. Cl. ..... 242/476.7; 242/154; 242/157
(58) Field of Search ..... 242/157 R, 483.6, 242/154, 476.7, 417.3, 417

(56) References Cited

U.S. PATENT DOCUMENTS 2,326,714 A * 8/1943 Wholton ..... 242/154
2,969,197 A * 1/1961 Weber et al. ..... 242/417.3
3,359,715 A * 12/1967 Mackie ..... 242/476.7
4,002,306 A 1/1977 Raasch
4,060,207 A * 11/1977 Miyazaki et al. ..... 242/476.7
4,113,193 A 9/1978 Raasch et al.
4,133,493 A * 1/1979 Schewe ..... 242/154
4,149,678 A * 4/1979 Miyazaki et al. ..... 242/476.7
4,169,564 A 10/1979 Lehmann et al.
4,312,482 A * 1/1982 Schewe ..... 242/154
5,158,241 A * 10/1992 Dammann et al. ..... 242/476.7

FOREIGN PATENT DOCUMENTS

| | | |
|---|---|---|
| EP | 0 285 204 | 10/1988 |
| GB | 555064 | 8/1943 |
| JP | 51-123331 | 10/1976 |
| JP | 54-147238 | 11/1979 |
| JP | 60-155736 | 8/1985 |
| SU | 1414744 | 8/1988 |

OTHER PUBLICATIONS

EP Search Report

* cited by examiner

*Primary Examiner*—Michael R. Mansen
(74) *Attorney, Agent, or Firm*—Hedman & Costigan, P.C.

(57) ABSTRACT

A device for collecting yarns on conical reels which compensates for the take-up pulsations of the thread winding onto the conical reel. The device comprises a fixed bar compensator at an adjustable oblique angle with respect to the winding line of the thread which varies the length of the free path of the traversing thread.

9 Claims, 4 Drawing Sheets

13
12
17
α
16
19
18
11
1'
31
1''
5
3
2
1

13
15
12
30
31
20
11
14
19
18
1''
1'
10
4
5
3
2
1

11
12
30
31
18
1'
1''
50
51
52
53
54
55
58

DEVICE FOR COLLECTING YARNS ON CONICAL REELS WITH COMPENSATION OF THE FLUCTUATIONS OF THE YARN TAKE-UP SPEED

BACKGROUND OF THE INVENTION

1. Description of Related Art

The present invention refers to the collection of the yarn produced or processed by textile machines to be wound onto reels. In industrial practice, the technique generally adopted is that of collecting the yarns by rotating a tube, carried idle by the spindles of a reel-carrying arm and taking up the yarn arriving from a feeding organ to wind it onto itself. The reel is thus formed by pulling and winding the yarn onto its surface, being rotated in turn with a driving roller underneath; the reel rests on this and winds the yarn at a substantially constant linear speed, irrespective of the dimensions assumed by the reel as winding proceeds, and depending only on the rotating speed of said driving roller. The yarn is thus wound in spirals onto the rotating reel and distributed with a backward and forward movement on its surface by a thread-guiding device.

For most of the subsequent uses of the yarn wound onto the reel in downstream processes, it is necessary for the reel to be conically shaped, this is typical when it is required to unwind the yarn axially from the fixed reel, placed on creels or similar supports.

2. Field of the Invention

The present invention refers more particularly to the downstream winding onto conical reels of the yarns produced, processed, fed or in any way obtained from textile machines located upstream at a constant speed.

A typical example of these textile machines which produce yarn at a constant linear speed is represented by rotor spinning machines, currently known as open-end spinning machines, while in the formation of the conical reel the collecting speed has a pulsating trend.

To illustrate thoroughly the questions involved with conical reels and the technical solutions proposed with the present invention, reference is therefore made, in the following description, to the collection of open-end yarns on conical reels, as an example without limitation.

The cause of the collection speed pulsation on a conical reel derives essentially from two circumstances. The first circumstance is the swinging distribution of the yarn on the reel being formed with a thread-guiding device ranging between the two winding ends. This range periodically lengthens and shortens the length of the section of swinging thread, from the last transverse restraint to the thread guide. It is minimum when the thread guide deposits the thread on the central part of the reel and the guide is at the half-way stage of its stroke, and it is maximum when the thread guide deposits the thread at the two bases of the reel and it is at the ends of its stroke. This periodic variation of the length of the thread path is therefore translated into a first pulsation of the thread take-up speed: at each moment it would be necessary to bring up from the bottom a length of thread corresponding to the length of thread wound onto the reel increased or decreased by the periodic variation of length—positive and negative—of the path which joins the organ supplying the thread at constant speed and the collecting organ at pulsating speed.

This first circumstance is shared with the procedure for winding onto straight cylindrical reels. The second circumstance, on the other hand, derives from the conical shape of the reel. Even though the mean collecting speed is kept the same as the speed at which the thread arrives from the open-end spinning machine, a second speed pulsation is encountered. Generally the semi-conical formation (or tilting) of the tubes is not very accentuated, being kept usually below 5°, but, at the present reel winding speeds, the consequent pulsations of the take-up speed are not at all negligible.

When the thread is wound onto the part with the largest diameter—currently at the bottom of the reel—it is picked up at a greater speed, higher than the speed at which the thread arrives at constant speed from the supplying spinning machine, and so it is subjected to greater tension; instead, when the thread is wound onto the part with a smaller diameter—currently at the top of the reel—the inverse situation occurs, the thread is loose because it is picked up at a lower speed, less than the constant speed of the thread arriving from the spinning machine.

The technical problem which is essentially presented for collecting yarn with winding on conical reels derives from the sum of the pulsations of the thread take-up speed and from the tensions which this produces in the thread in the absence of effective remedies. In addition to the periodic pulsation of the thread take-up due to the variation of the transverse coordinate of the instantaneous point of winding, there is the periodic speed pulsation due to the more or less accentuated conical shape of the reel being formed. The trend of the sum of the two pulsations with reference to the transverse coordinate of the traversing path is not linear, but presents a trend with a positive and increasing derivative in the direction of the greater diameter of the reel being wound. This trend is schematically illustrated in FIG. 1. In short, the basic problem lies in having to combine a system for the production of yarn supplied intrinsically at a constantly linear speed with a collecting system which instead collects it intrinsically at a pulsating linear speed with considerable frequency around a mean value which corresponds to the speed of delivery. There must also be considered the necessity that the tension of the winding thread must be very precisely regulated throughout the duration of winding, depending on the density and on the consistency required for the subsequent use of the reel; for high quality reels the precision required is reckoned in gram/weight.

In the prior art numerous technical solutions have been proposed for the problems connected with this type of winding. During reel rotation, drive rollers are generally used which have an annular strip with a greater friction coefficient to determine the drive point on the generatrix of the conical reel and therefore the transmission ratio between roller and conical reel.

U.S. Pat. Nos. 4,002,306 and 4,113,193 teach how to insert in the path of the thread being collected a line of deviating elements, which may be alternatively spaced from one another transversely by the action of springs under tension, which cause the thread to have a movement that is all the more tortuous, the lower the tension of the thread. This system allows the creation of a reserve length of thread when it is not very tight and to return it when the thread tension returns. In U.S. Pat. Nos. 4,133,493 and 4,312,482 a similar system is proposed for creating a path with variable tortuousity depending on the thread tension.

These technical solutions require relatively high yarn tensions in order to follow the frequency of the pulsations during winding, and they involve a complex mechanical control. They do not allow the production of soft reels and they require limitation of the yarn take-up speed, due to the quite appreciable masses in alternative motion.

Technical solutions have also been proposed that are based on the variation of the transmission ratio between the drive roller and the driven reel, shifting the drive point on the generatrix of the conical reel alternately towards the bottom and the top of the conical reel, depending on the tension values found in the yarn being picked up, for example as described in patent EP 285.204 in the name of the same applicant. The devices of the prior art are complicated, expensive and their applications are limited.

SUMMARY OF THE INVENTION

The aim of the present invention is to realise a device for collecting, on conical reels, yarns produced or supplied at a constant linear speed by textile machines located upstream, which overcomes the inconveniences of the devices of the prior art.

The device according to the invention is defined, in its essential components, in the first claim, while its variants and preferential embodiments are specified and defined in the dependant claims.

BRIEF DESCRIPTION OF THE DRAWINGS

To illustrate more clearly the characteristics and the advantages of the present invention, it is described with reference to some of its typical embodiments shown in the figures from 1 to 5, as an example without limitation.

These figures refer to an embodiment of the device according to the invention for collecting the thread produced by an open-end spinning machine, of which is shown only the system of the yarn extraction roller, to illustrate the characteristics and the benefits deriving from the present invention.

DETAILED DESCRIPTION OF THE INVENTION

Figure 3:
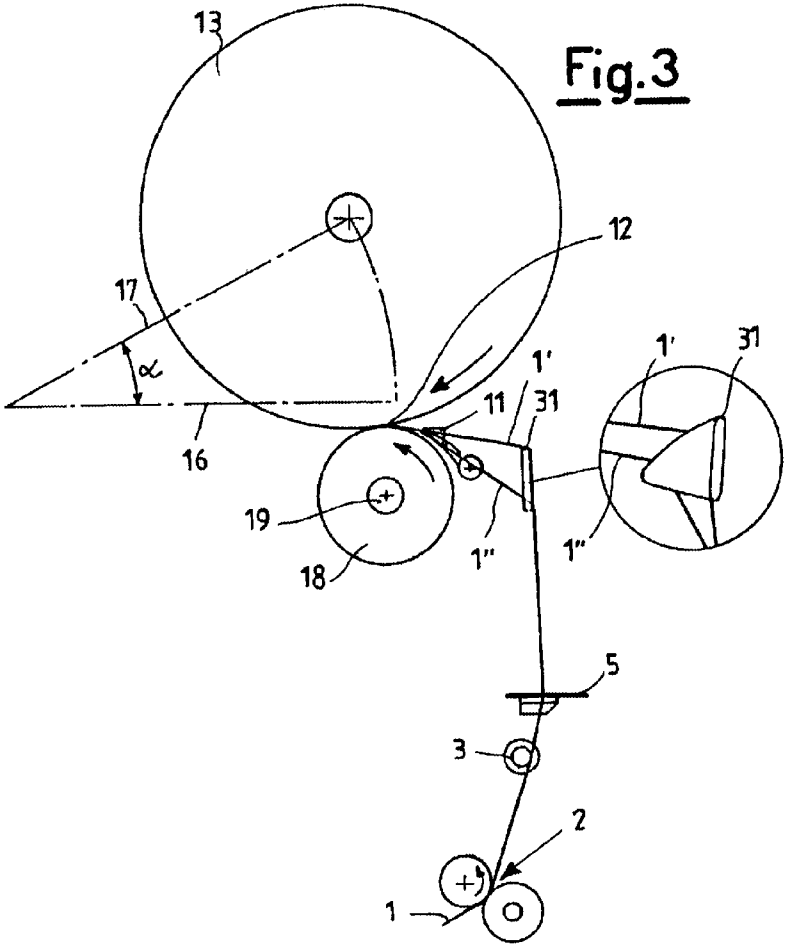
FIG. 3 illustrates the same embodiment of the device for collecting open-end yarn, seen from the side.
Figure 2:
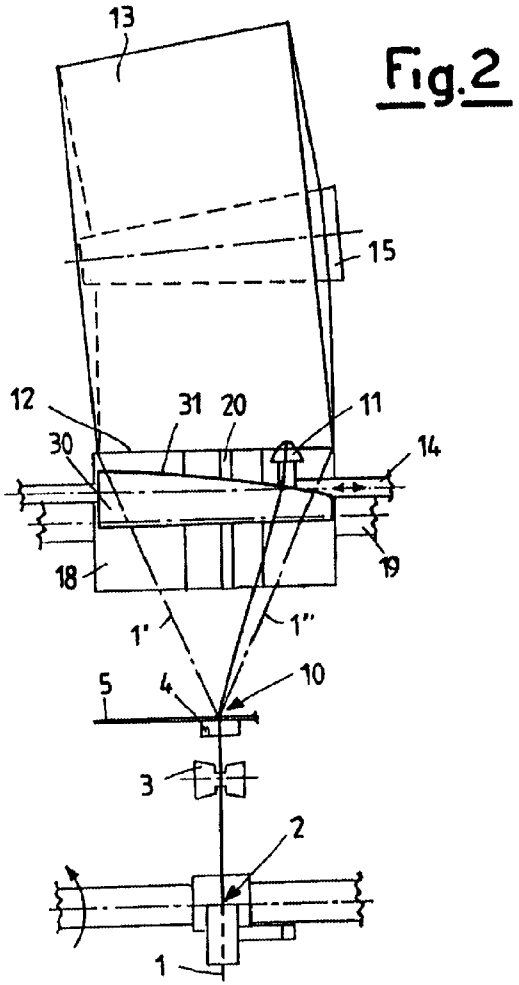
FIG. 2 shows a typical embodiment of the device for collecting open-end yarn, seen from the front.

FIGS. 2 and 3, respectively with front and side view, illustrate the yarn collecting device in the path from upstream to downstream, from the outlet of the open-end spinning machine to the wound conical reel.

The open-end yarn 1 comes from below and is fed to the collecting device above by a pair 2 of extraction rollers. Generally one of this pair of rollers is a drive roller activated with a constant speed and the other is an idle counter-roller. They grip the open-end yarn between them and feed it at a predetermined constant speed, extracting it from the spinning rotor. If the yarn 1 is picked up by the device above at an instantaneous linear speed higher than that of the rollers 2, it is clear that there will be some inconveniences anyway; if there are no remedies for this discrepancy in speed and for compensating the increased take-up by the reel, the thread will break when the take-up exceeds the stretching allowed by the elasticity of the thread itself.

From the rollers 2 the yarn 1 goes up, passes over a transmission roller 3, and continues on its route, passing through the thread presence sensor 4, inserted under a plate 5 which supports it, corresponding to its V-shaped insertion slot.

From the vertex 10 of the V-shaped slot the thread 1 goes to the thread guide 11 which distributes it on the reel with a traversing movement. The path of the winding yarn is kept on a substantially rectilinear and vertical plane in the interval between the extraction rollers 2 and from the vertex 10 of the V-shaped insertion slot in the plate 5. Starting substantially from the point defined by the vertex 10, the yarn 1 begins to receive the traversing movement and swings transversely between the two ends of the traverse guide as an effect of the movement of the thread guide 11 downstream.

Figure 1:
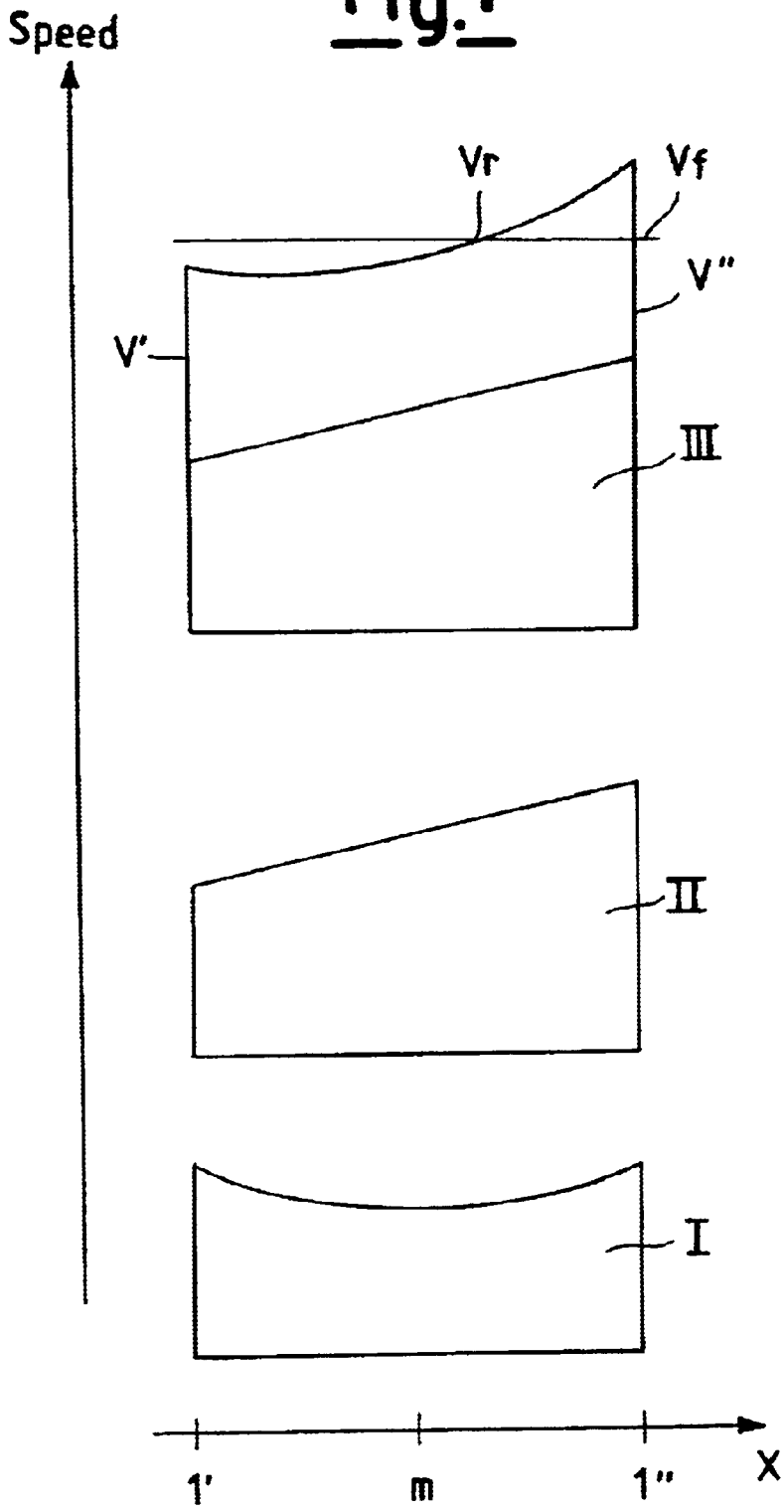
FIG. 1 indicatively illustrates the trend of the pulsating take-up speeds of the conical reel in every point of the transverse stroke of the thread guide, to highlight the problem to be tackled.

In the point of engagement with the thread guide 11 and on the line 12 of its winding onto the reel 13 the thread 1 is animated by a pulsating take-up speed which corresponds to the trend indicatively shown in FIG. 1.

The thread guide 11 is keyed onto a horizontal bar 14, preferably common to all the thread guides of the units aligned on the front of the open-end spinning machine, animated by a backward and forward movement with an amplitude corresponding to the desired traverse between the extreme positions corresponding to the width of the reel, shown with the dashed lines 1' and 1" which correspond respectively to the position of the thread being wound onto the top of the reel and onto the bottom of the reel 13. As already described in the introductory statements, the path that goes from the vertex 10, that is from the thread sensor 4, to the thread guide 11, that is to the point of winding onto the reel 13, varies continuously and has the maximum length in the extreme positions 1' and 1" of the stroke, while it assumes the minimum length in the instants in which the thread is wound onto the centre part. The difference between the minimum and maximum paths is significant and may reach as much as 10–15%.

The diagram in FIG. 1 has an indicative character to illustrate the trends of the take-up speed shown on the Y-axis with respect to the transverse coordinate of the thread guide 11 shown on the X-axis; it shows the trend I of the length of the section of thread swinging between the extreme positions 1' and 1", which corresponds to the consequent trend of the take-up speed, referring to the transverse coordinate x. Note that this variation in speed is due only to the transverse movement of the thread guide and that it has a trend following a curve that is concave at the top and with the minimum value in the mid-point m of the stroke.

The same diagram also shows the trend II of the thread take-up speed between the extreme positions 1' and 1", always with reference to the transverse coordinate and due to the conical shape of the reel. It has a substantially rectilinear and growing trend.

The sum III of the two trends I and II represents the overall take-up speed $V_r$ exerted by the conical reel 13 fed by the thread guide 11; it has a growing trend, with a growing derivative. The constant speed with which the open-end spinning machine upstream supplies the thread is represented by $V_f$ and corresponds to the mean value of the pulsating take-up speed $V_r$ between the minimum value V' and the maximum V".

The reel 13 is obtained by winding the yarn 1 onto the tube 15 held by a reel-carrying arm, of which a dot-and-dash line indicates respectively the initial position 16 when the tube is empty and the position 17 corresponding to the dimension of the reel 13 shown in the drawing. With the winding shown in the figure, the reel-carrying arm has been raised with respect to its operating roller 18, moving away gradually and performing a rotation α.

The roller 18 is keyed onto the rotating shaft 19 common to all the units aligned on the front of the open-end spinning machine, and it has a drive strip 20 with protruding relief which determines the transmission ratio of the movement between the reel and the cylinder.

One of the peculiar components of the take-up device according to the invention is the compensator 30 which accumulates the thread reserve when the take-up speed $V_r$ is lower than the speed $V_f$ at which the thread arrives from the spinning machine and releases it when this speed ratio is inverted. The compensator 30 is inserted in the swinging path of the thread 1 between the thread sensor 4 and the thread guide 11, and preferably immediately before said thread guide.

It performs its function by causing the thread 1, arriving from below, to follow paths of different lengths, regulated according to the instantaneous position of the thread guide 11 in its transverse stroke. The deviation increases more and more the length of the path that the thread 1 is made to follow during its movement towards the top of the reel, while the deviation decreases more and more the path that the thread 1 is made to follow during its movement towards the bottom of the reel. Considering the characteristics of the conical reels required for collecting thread from the present open-end spinning machines, the reserve quantity that must be accumulated and released at every backward and forward movement required for each pulsation is about 40–80 mm.

In the example shown in FIGS. 2 and 3 this fixed compensator 30 consists of a bar or plate body, having an upper deviation profile 31 and contact with the thread 1. The fixed compensator is positioned with respect to the winding station in such a way that said profile 31 is at an oblique angle with respect to the winding line 12 which is in turn parallel to the trajectory of the thread guide 11. In the example in FIGS. 2 and 3, the profile 31 is realised as lying in the vertical plane and is tilted with a slope opposed to that of the cone of the reel 13; it is therefore not in the same plane as the generatrix 12 of the reel 13 on which the thread is deposited. This upper profile 31 is preferably realised with a rounded shape, materials and finish such as to allow easy running of the thread 1, guided transversely by the thread guide 11 and taken up by the rotation of the conical reel, always with a pulsating speed trend. As shown in FIGS. 2 and 3, during winding the thread 1 has a backward and forward movement between the extreme positions 1' and 1". As illustrated with reference to FIG. 2, going towards the tip as far as the extreme position 1', the thread is taken up at a lower speed at the small end of the reel and goes up towards the left along the oblique profile 31 of the compensator 30, which gives the thread a more deviated, longer path as far as 1', as shown in the side view in FIG. 3. When the thread returns towards the right as far as the other extreme position 1", the reel take-up speed increases and the thread goes down along the oblique profile 31 of the compensator 30, which gives the thread a less deviated, shorter path as far as 1", as shown in the side view in FIG. 3. The difference in length between the two extreme paths 1' and 1" creates the thread reserve which the fixed compensator 30 is able to accumulate and release in order to compensate the pulsations of the thread take-up speed with the conical reel. The amount of the thread reserve thus available depends on how much the profile 31 is oblique, that is out of plane, with respect to the line 12, that is to the trajectory of the thread guide 11 which is very close to it. This out-of-plane position may be achieved not only by placing the two working ends of the profile at different levels of the same vertical plane as shown in the example in FIGS. 2 and 3. They may also be offset in the horizontal plane, that is, as shown in the enlarged detail in FIG. 3, by offsetting them as both vertical and horizontal coordinates, and specifically by placing at the smaller end of the reel the end of the profile 31 higher than and farther from the line 12, and placing at the larger end of the reel the end of the profile 31 lower than and closer to the line 12.

The profile 31 may be realised with a rectilinear or curved geometric trend, or with broken lines, to realise with sufficient approximation a predetermined trend of the length of the thread path between the thread guide 11 and the vertex 10, corresponding to the amount of thread reserve accumulated with respect to the instantaneous transverse coordinate of the thread being wound.

In practical application, the point by point trend of the profile 31 may be defined in its spatial development with respect to the point of winding in conformity with the point by point need for reserve according to the trend III in FIG. 1. In this case it is necessary to build the real curve of the trend III in FIG. 1, referring to the conditions required for a specific winding: dimensions and shape of the reel, winding angles, speed of thread arrival, geometry of the winding device, and so on. In this way, for that specific winding, the instantaneous yarn reserve is made correspond to the instantaneous ratios between the take-up speed $V_r$ from the reel 13 and the speed $V_f$ at which the thread arrives from the spinning machine. The profile 31 is shown in FIG. 2 with a curved trend, but in actual practice it may be approximated with a rectilinear segment or a broken line which correspond sufficiently to its trend and at any rate produce the required thread reserve.

As illustrated in FIGS. 4A—4D, the fixed compensator 30 with a profile 31 for deviating the thread may be adapted with good approximation to different winding mode requirements, depending on the parameters described above. It is realised with a bar 30 with positioning that may be oriented in space so as to adjust the degree by which the profile 31 is out of plane with respect to the winding line 12, that is with respect to the trajectory of the thread guide 11 with shifting of one or both of its ends, varying their coordinates in the vertical and/or horizontal plane.

Figures 4A, 4B, 4C, 4D:
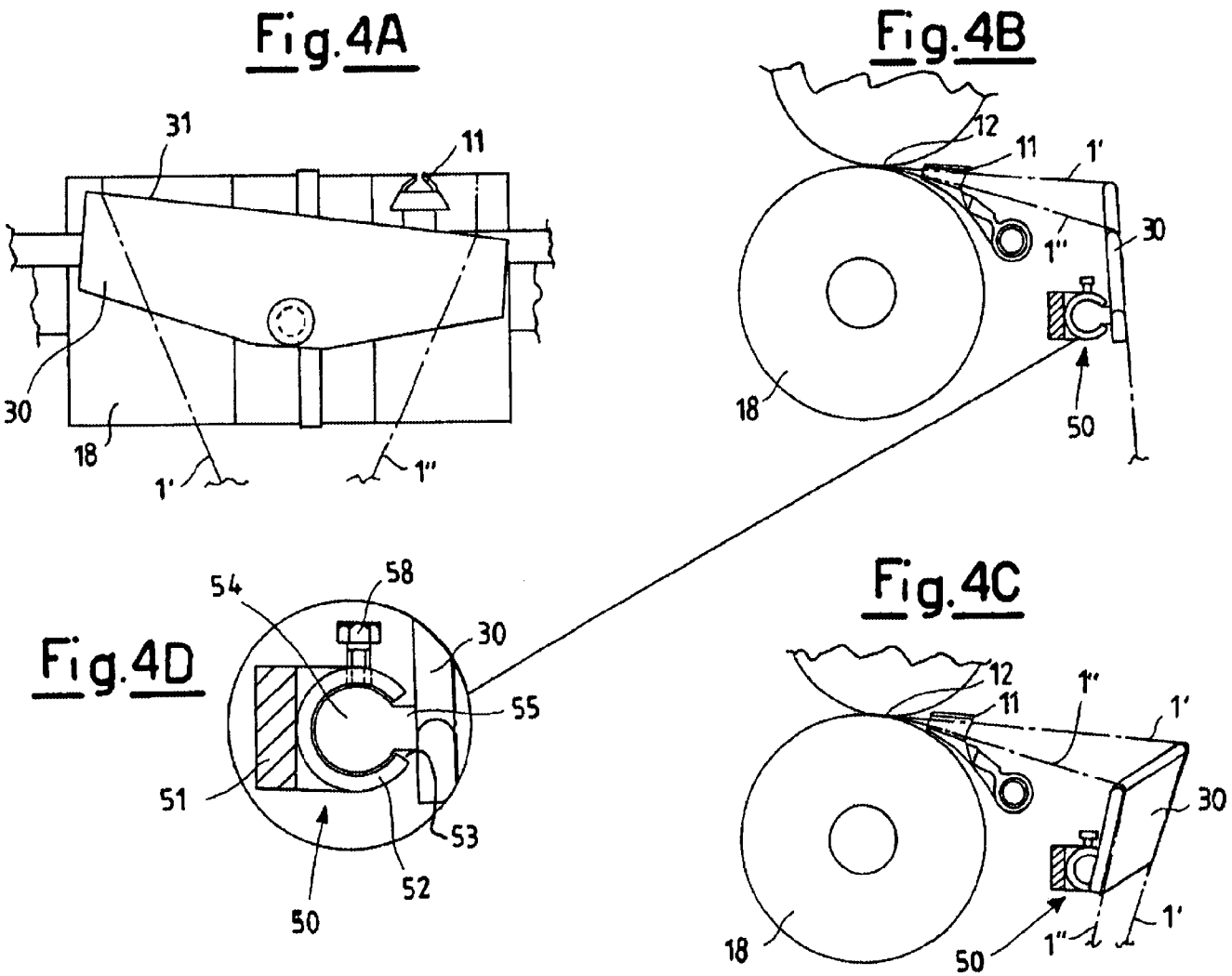
FIG. 4A shows in greater detail the compensator which creates the thread reserve that allows compensation of the take-up speed pulsations, with the possibility of regulation to adapt to the production of different kinds of reels.
FIG. 4B shows a side view of an arrangement of the compensator.
FIG. 4C shows the same view as 4B but with the compensator offset through the vertical and horizontal planes.
FIG. 4D shows in greater detail the spherical articulation.

FIG. 4A shows in the centre a front view, while FIG. 4B shows a side view of a regulation modulated only in the vertical plane and FIG. 4C shows a regulation modulated according to the vertical and horizontal coordinates of the position in space of the profile 31.

For this regulation of the spatial orientation of the profile 31, the bar 30 is connected to a spherical articulation 50, fastened in turn to an element 51 of the fixed structure of the machine. The spherical articulation 50 consists of a fixed hollow body 52 with a spherical female socket, having a front opening 53. Fitted inside the cavity in the body 52 is a spherical male body 54 of a suitable shape, able to move at an angle with respect to the cavity, its rotations being limited by the opening 53. The male body 54 has a short rod 55 passing with notable tolerance into said front opening 53 and it is integral with the bar 30 of the fixed compensator. The larger dimension of the opening 53 with respect to the transverse dimension of the rod 55 allows significant rotations of the bar 30, both with respect to the horizontal axis parallel to the front of the machine and with respect to the horizontal axis perpendicular to the front of the machine, thus spatially orienting the profile 31.

In the set of views shown in FIG. 4, in the front-view figure the profile 31 is shown tilted towards the right, at the bottom of the conical reel. In the two side views, instead, two possibilities are proposed which do not appear to be substantially different in the front view.

The view in FIG. 4B shows the effect of the regulation with the spherical articulation 50 to orient the profile 31 only in the vertical plane, with the two thread paths 1' and 1" which differ from each other substantially only in the final section.

The view in FIG. 4C shows the effect of the regulation with the spherical articulation 50 to orient the profile 31 differing its two ends also as regards the horizontal distance from the winding line 12. With this regulation the two thread paths 1' and 1" differ from each other substantially in the whole path of the thread.

In the fixed hollow body 52, means are inserted for blocking and releasing the spherical male element 54, as for example the pressurised screw 58, which may be slackened to modify the spatial position of the profile 31 and then blocked in position again. An alternative to the spherical articulation for the spatial regulation of the fixed compensator 30 is composed of two cylindrical articulations in series, for example with axes at right angles to each other and placed in the horizontal plane, likewise provided with means for blocking and release.

The fixed compensator 30 of the device according to the invention is able to exert its compensating function, creating and promptly yielding its thread reserve, and is also able to adapt to the requirements of different modes of gathering the yarn with regulations of its spatial position with respect to the other parts, without affecting moving parts which could lead to inconvenience and delays.

A preferred embodiment of the device according to the present invention is illustrated with reference to FIG. 5. According to this preferred embodiment, associated with the fixed compensator 30 which performs the prevalent part of compensating the take-up pulsations, there is a mobile compensator 40 which cooperates with the fixed compensator 30 and creates an additional thread reserve, as it too deviates the thread 1 from its path.

This mobile compensator 40 is preferably positioned at the start of the thread path between the extraction rollers 2 and the transmission roller 3. In the embodiment shown as an example in FIG. 5, this mobile compensator essentially consists of a mobile transmission 41, with a hook, eyelet or deviating roller, placed at the end of a lever 42 that swings hinged onto the structure with a pin 43. The mobile transmission 41 engages the thread 1 and is provided with pulling means 44, for example a settable spring 44, which tend to shift the thread 1 towards the inside, creating a loop 45 in its upward path. The action of deviating the thread by the spring 44 is contrasted by the tension of the thread itself and so the loop 45 has a pulsating trend depending on the pulsations of the speed and of the thread take-up tension from the top. The variations in length of the thread path as an effect of the pulsation of the loop 45 therefore result in a further reserve of thread which accumulates and is returned with the pulsations of the take-up from the reel.

Figure 5:
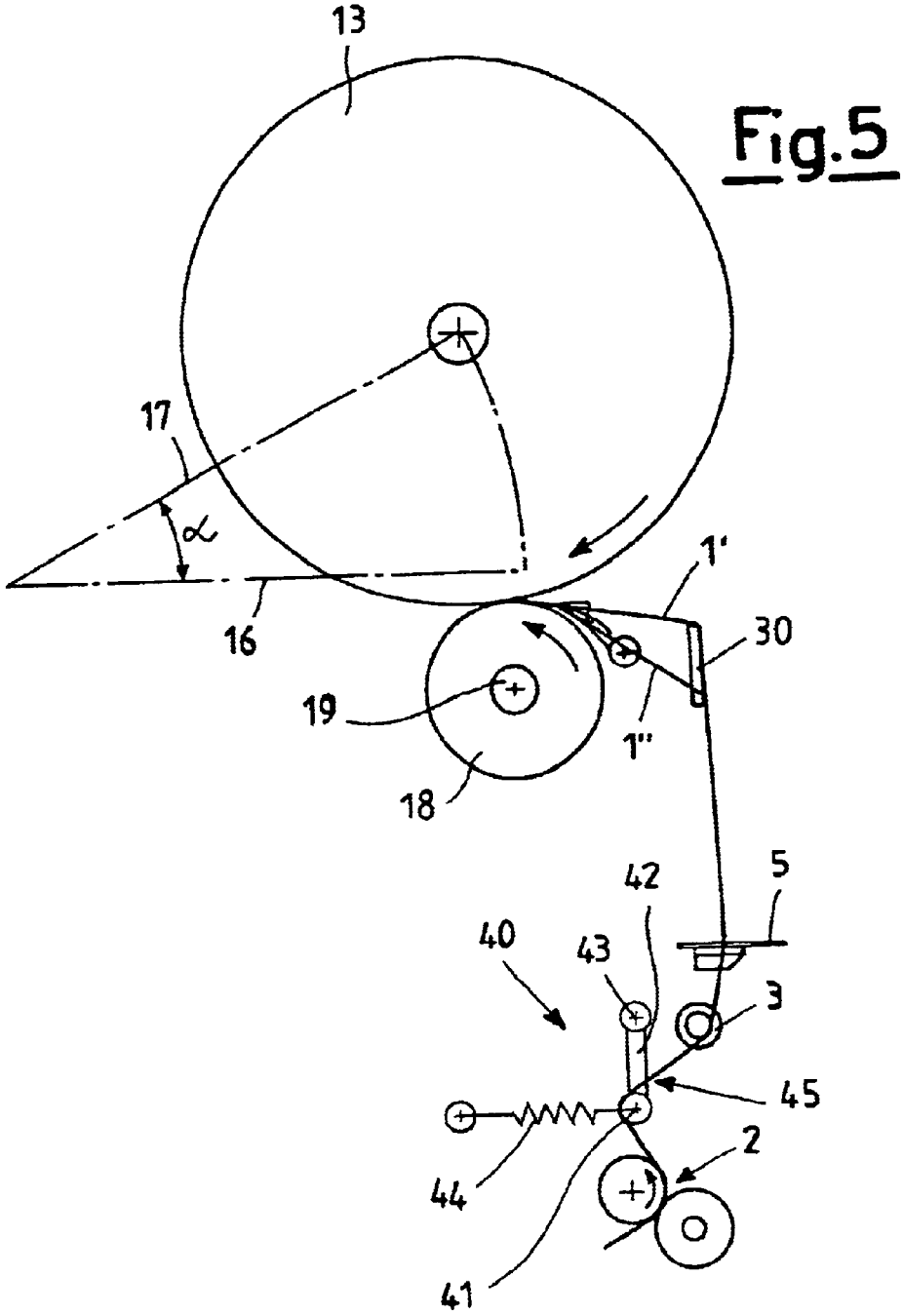
FIG. 5 illustrates an alternative and preferred embodiment of the winding device according to the invention.

The alternative embodiment illustrated in FIG. 5 presents considerable advantages. It allows not only a substantial increase of the overall quantity of thread which makes up the reserve, but also the realisation of a device that is easily adapted to the whole range of the possible requests of real winding on an open-end spinning machine, which with only the regulation of the space orientation of the bar with the profile 31 of the fixed compensator would be difficult to follow closely always with the same bar. The embodiment with a double compensator therefore allows the adaptation of compensator bars with a simpler profile, for example with a rectilinear trend, since the mobile compensator raises the degree of faithfulness of the instantaneous correspondence between the reserve and the trend of the take-up pulsation. It is also able to compensate any irregularities of the speed of arrival of the thread to be collected.

The alternative embodiment illustrated in FIG. 5 is also especially advantageous when the thread has to be collected at a higher speed and there is an increase in the frequency of the strokes of the thread guide 11 and of the swinging movements of the mobile compensator 40. The mobile compensator 40 essentially has the function of making the thread reserve trend more faithful with respect to the pulsating take-up trend of the conical reel being wound, and so there are shorter swinging strokes.

A swinging of the lever 42 with small amplitude involves small amounts of movement, a low average speed and low forces of inertia of the overall system. The system of the two combined compensators 30 and 40 faithfully follows the pulsations of the take-up speed and accumulates and releases the thread reserve faithfully and with negligible delays.

What is claimed is:

1. Device for collecting yarns for producing conical reels with control of the tension and speed of a thread having a path (1) which goes from a supply of the thread through feeding means (2) to its collection on a conical reel (13) comprising a fixed compensator (30) of the take-up pulsations of the thread from the conical reel, situated between a point (10) in which the thread (1) starts to receive a traversing movement from a thread guide (11) and the thread guide itself, said fixed compensator (30) consisting of a bar body, having an upper profile (31) in contact with the thread (1) and positioned with respect to the winding station placing its profile (31) at an oblique angle out of plane with respect to a winding line (12) of the thread (1) or to the trajectory of a thread guide (11) by offsetting the two working ends of the profile (31) through vertical and/or horizontal coordinates; said device further comprising means for regulating the out-of-plane position of said profile (31) with respect to said winding line (12), comprising a connection of said bar (30) to a fixed structure of said device with a spherical articulation (50) in which is inserted means for blocking and release (58).

2. Device for collecting yarns according to claim 1, characterised in that the out-of-plane position of the profile (31) with respect to the winding line (12) is realised by placing the two working ends of the profile (31) at different levels of the same vertical plane.

3. Device for collecting yarns according to claim 1, characterised in that the out-of-plane position of the profile (31) with respect to the winding line (12) is realised by offsetting the two working ends of the profile (31) in the horizontal plane of compensator (30) whereby a first working end is moved closer to winding line (12) and a second working end is moved farther from winding line (12).

4. Device for collecting yarns according to claim 1, characterised in that the out-of-plane position of the profile (31) with respect to the winding line (12) is realised by offsetting the two working ends of the profile (31) by rotation of compensator (30) about its vertical and horizontal axes.

5. Device for collecting yarns according to claim 1, characterised in that the profile (31) has a rectilinear or curved geometric trend, or with broken lines, to realise with sufficient approximation a predetermined trend of the length of the thread path between the thread guide (11) and the vertex (10), corresponding to the amount of thread reserve accumulated with respect to the instantaneous transverse coordinate of the thread being wound.

6. Device for collecting yarns according to claim 1, characterised in that associated with the fixed compensator (30) there is a mobile compensator (40) to create an additional thread reserve, as it too deviates the thread (1) from its path.

7. Device for collecting yarns according to claim 6, characterised in that the mobile compensator (40) is positioned at a start of the thread path between extraction rollers (2) and a transmission roller (3).

8. Device for collecting yarns according to claim 6, characterised in that the mobile compensator (40) consists essentially of a mobile transmission (41) which engages the thread (1) and is provided with pulling means (44) to shift the thread (1) towards the pulling means (44), in contrast with the tension of the thread itself, creating a loop (45) in the thread's path.

9. Device for collecting yarns according to claim 8 characterised in that the mobile compensator (40) is composed of a lever (42), hinged onto said device with a pin (43) and provided with the transmission (41) of the thread (1) at the non hinged end.

* * * * *